United States Patent [19]

Andersen

[11] 4,248,545

[45] Feb. 3, 1981

[54] DEEP DRAWING PRESS WITH BLANKING AND DRAW PAD PRESSURE CONTROL

[75] Inventor: Dennis H. Andersen, Minnetonka, Minn.

[73] Assignee: MTS Systems Corporation, Eden Prairie, Minn.

[21] Appl. No.: 941,387

[22] Filed: Sep. 12, 1978

[51] Int. Cl.[3] ..... F16D 1/00

[52] U.S. Cl. ..... 403/227; 403/223

[58] Field of Search ..... 403/132, 133, 137, 220, 403/227, 223

[56] References Cited

U.S. PATENT DOCUMENTS

| | | | |
|---|---|---|---|
| 216,551 | 6/1879 | Bilz | 308/136 |
| 1,660,676 | 2/1928 | Josephs | 105/452 |
| 2,108,746 | 2/1938 | Erichsen | 100/53 |
| 2,547,725 | 4/1951 | Thompson | 274/39 |
| 2,556,984 | 9/1941 | Lemen et al. | 105/44 |
| 2,697,578 | 12/1954 | Whittam | 248/358 |
| 2,709,598 | 5/1955 | Retz | 403/227 X |
| 2,778,664 | 1/1957 | Herbener | 403/220 X |
| 3,042,394 | 7/1962 | Bliss | 403/220 X |
| 3,908,429 | 9/1975 | Gram | 72/349 |
| 3,944,376 | 3/1976 | Hata | 403/132 |
| 4,163,617 | 8/1979 | Nemoto | 403/133 X |

*Primary Examiner*—Leon Gilden

*Attorney, Agent, or Firm*—Kinney, Lange, Braddock, Westman and Fairbairn

[57] ABSTRACT

The present invention relates to single actuator blanking and draw pad force control for a drawing press, which includes a unique swivel for the hold down pad comprising a confined elastomeric member which has high axial stiffness, but relatively low rotational or pivoting stiffness about an axis normal to the actuator axis. Further, the pad can be combined with air pressure for holding a sheet of material during the blanking and drawing operations.

5 Claims, 5 Drawing Figures

FIG. 2
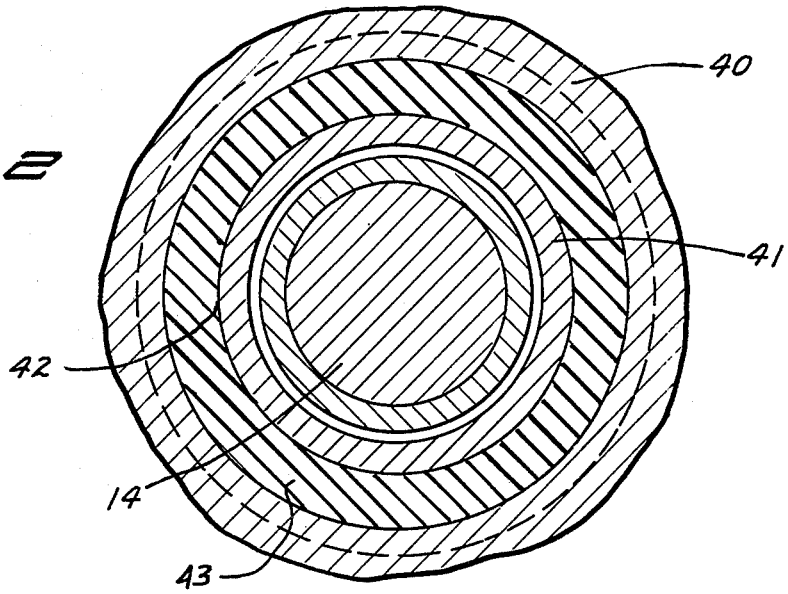
FIG. 3
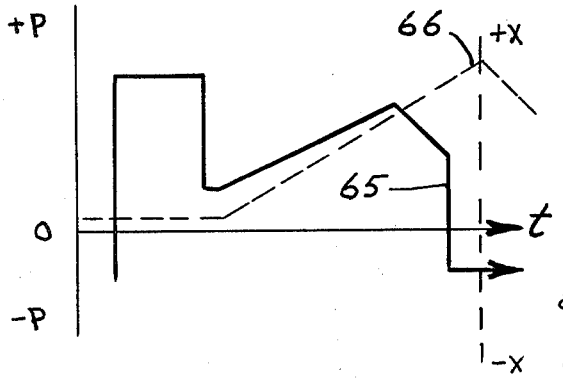
FIG. 5
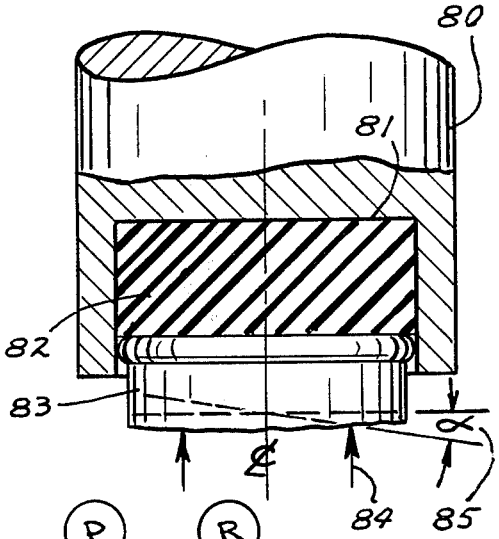
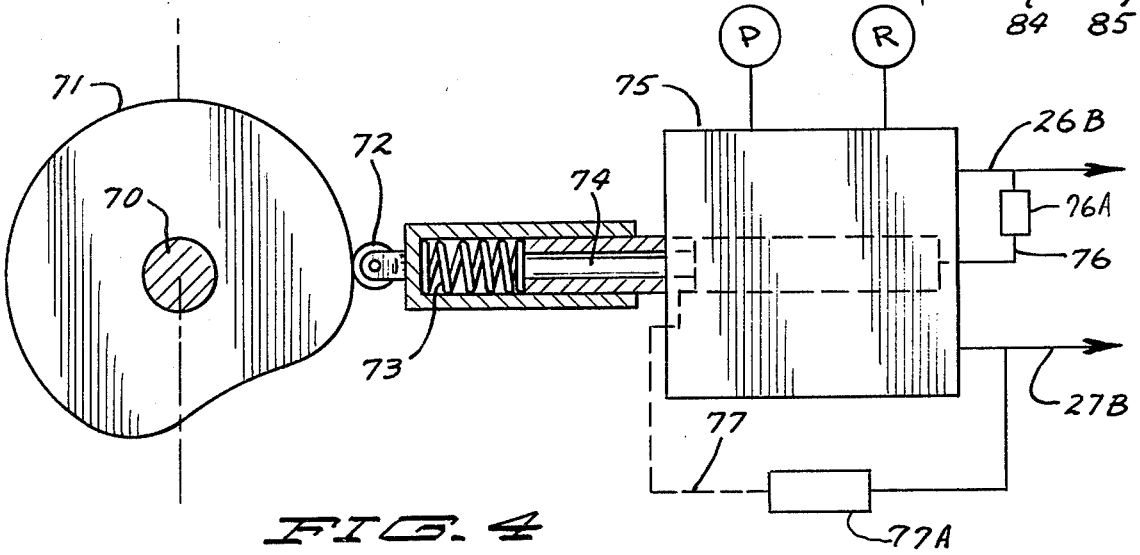
FIG. 4

DEEP DRAWING PRESS WITH BLANKING AND DRAW PAD PRESSURE CONTROL

BACKGROUND OF THE INVENTION

1. Field of the Invention

The present invention relates to fluid pressure actuated draw pad pressure control in drawing presses.

2. Prior Art

U.S. Pat. No. 3,908,429 illustrates a type of servovalve controlled hydraulic cupping press which includes hydraulically operated rams, hold down and blanking cylinders, and which provides precise feedback of the draw punch position for controlling of the various pressures.

In converting existing mechanical type presses, as well as existing hydraulic presses to have hydraulically actuating blanking and draw pad cylinders, it has been found the assemblies can be simplified by utilization of a unique swivel in the draw pad which is made of a confined elastomeric material.

Various types of elastomeric pads have been investigated. For example U.S. Pat. No. 2,108,746 shows a safety device for machine parts which utilizes an elastomeric material that is capable of flowing when a predetermined pressure limit is reached.

U.S. Pat. No. 216,551 illustrates a fifth wheel for a vehicle which has a ring of elastomeric material in it to prevent rattling and noise.

Other devices which use elastomeric material which is partially constrained to form a combined spring and damper to reduce noise and vibration include U.S. Pat. Nos. 1,660,676; 2,256,984; 2,547,725; and 2,697,578.

SUMMARY OF THE INVENTION

This invention relates to hydraulically actuated presses and in particular metal blanking and programmed draw pad pressure controlled presses for deep drawing of metal blanks. In particular the device comprises single actuator control of a blanking and draw pad pressure which can be programmed as a function of the punch stroke if desired, or can be mechanically operated through cam operation. The pad is cushioned with a constrained elastomeric member that acts much like a sluggish fluid and has great stiffness in axial direction, but yet will permit tilting of the draw pad about a transverse central axis to conform to irregularities in the blank. This eliminates the need for mechanical springs, and gives high reliability and long life as well as accurate control of draw pad pressures.

In the form shown, the draw pad comprises a ring which holds a cut blank, and the resilient or elastomeric member is contained within a chamber that is also annular and encircles the drawing punch. The material acts much like a viscous fluid within this chamber. An annular metal ring serves as a piston and seal to contain the elastomeric material in a closed cavity, and is engaged by the draw pad. If unequal forces are applied to the pad, the pad will tend to tilt and cause the elastomeric material to flow annularly. The tilting can occur easily because of the flow of the elastomer, but yet an axial force, that is, a force parallel to the direction of the drawing punch movement will be resisted with stiff spring action, i.e. the bulk modulus of the elastomeric material.

The arrangement permits the conversion of existing draw presses to hydraulic operation of the blanking and hold down pad control in a simple, convenient and inexpensive manner. The controls for the blanking and draw pad cylinder may be either servovalve controls or mechanical cam type controls.

BRIEF DESCRIPTION OF THE DRAWINGS

FIG. 2 is a sectional view taken as on line 2—2 in FIG. 1;

FIG. 3 is a graphic display of the relative operations formed by the hold down and draw pad control in relation to the punch stroke;

FIG. 4 is a schematic representation of a mechanical cam for operating a hydraulic valve and with the control cylinder such as that shown in FIG. 1; and FIG. 5 is a vertical section view of a modified form of elastomeric swivel joint which is used in principle in the device of FIG. 1.

DESCRIPTION OF THE PREFERRED EMBODIMENTS

Figure 1:
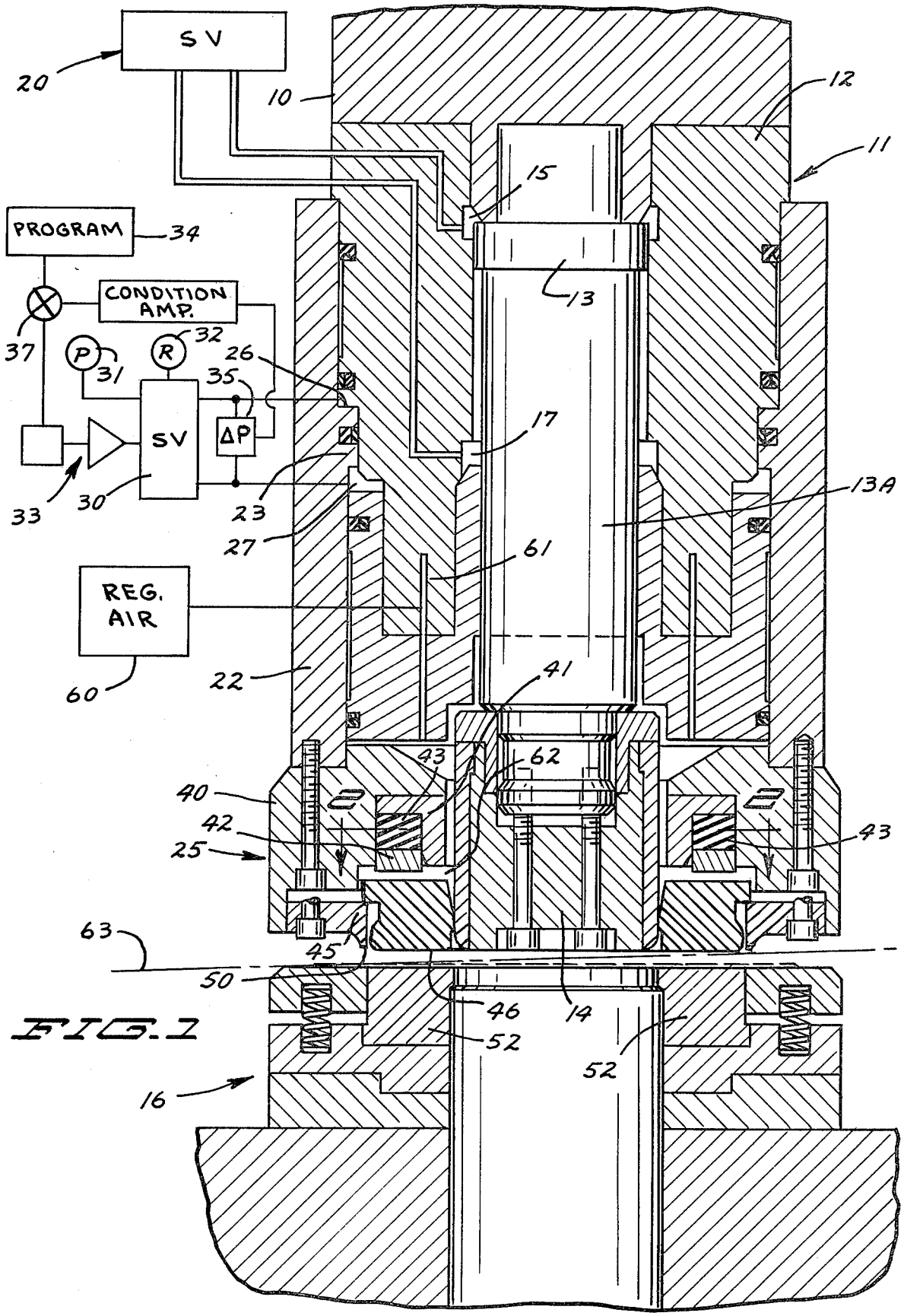
FIG. 1 is a vertical sectional part schematic view of a typical press and showing a hold down and drawing pad mounting and control made according to the present invention.

FIG. 1 schematically represents an actuator for actuating a punch for deep drawing cans, similar to the actuators illustrated in U.S. Pat. No. 3,908,429. The operation, tooling, and frame supports can be the same as in that patent, and the interior punch member can be of any desired configuration. Thus these members are shown only schematically.

A load frame 10 is used for supporting a punch or deep draw forming cylinder assembly indicated at 11. This includes a main cylinder body 12 that is attached in a suitable manner to the frame 10, and includes a central piston and rod assembly including a piston 13 which is positioned within the interior of cylinder 12 and a rod 13A which is suitably guided in place. The rod carries a punch member 14 at the lower end thereof. The punch member is multi-section and may have its outer surface section made of special material to aid in the drawing operation. The piston 13 is actuated through an upper cylinder chamber 15 for forcing it downwardly to do deep drawing relative to a tooling set including a deep draw die whcih is indicated generally at 16. The upper cylinder 15 thus provides pressure on the piston 13 to move the rod and punch down toward the die set 16, and a lower cylinder section 17 is used for lifting the piston and rod assembly. This also lifts the punch upwardly at the end of a drawing operation.

The cylinder can be suitably controlled through a servovalve indicated schematically at 20. The servovalve controlling the punch would have suitable control and feedback arrangements as shown in U.S. Pat. No. 3,908,429 to accomplish the purposes of deep drawing metal blanks that would be used in connection with the tooling assembly 16.

Surrounding the main body 12 is a tubular sleeve assembly 22, which includes a piston portion 23 that extends annularly around the body 12 and forms a pair of chambers for receiving hydraulic fluid to actuate the sleeve 22 in direction toward and away from the tooling set 16. This cylinder is independent of the operation of the piston and rod 13, and is used for controlling a cutter ring and hold down or draw pad assembly indicated generally at 25.

The piston 23 forms a chamber indicated generally at 26 above the piston, and another chamber indicated at 27 below the piston, both of which are open through suitable passageways shown only schematically to a servovalve 30. The servovalve 30 includes a pressure supply 31, a return 32, and suitable control circuitry 33, which is provided for controlling the servovalve in response to an input program from a programmer 34 in the usual manner. A differential pressure sensor 35 provides a feedback signal through suitable conditioning circuitry and amplifiers 36 to stablize the output and provide a signal through a summing junction 37 and through suitable gain amplifiers, and rate compensators indicated generally in the drawings to drive the servovalves in a desired manner.

The draw pad and hold down pad assembly indicated generally at 25 includes a mounting ring 40 that is suitably mounted to the sleeve 22, at the lower end thereof. This ring 40 has an insert member 41 attached thereto, which together with the ring 40, forms an annular cylinder or chamber 42 which receives a filling of elastomeric (rubber) material indicated at 43. The material 43 has an annular ring type piston 44 bonded to it, and forming an assembly to fit within the annular chamber 42.

As explained, this material 43 is selected so that it will tend to flow to fill the available space in the cylinder 42 upon eccentric load being applied to the ring 44, but will carry high loads in axial direction of the piston 13 and rod 13A for example.

A blanking and lift off ring 45 is bolted to the lower portion of ring 40, and retains a draw pad in place. The draw pad 46 has a surface positioned below the lower surface of the piston 42, as shown. The draw pad 46 is annular and surrounds the punch 14 that is attached to the piston rod 13A. The ring 45 has a shoulder which faces upwardly and which serves as a lift off ring for lifting the draw pad 46 upwardly when the sleeve 22 is raised through the action of hydraulic fluid under pressure in chamber 27. The ring 45 has a cutting edge 50 which in cooperation with a stripper plate 51 forming part of the tooling 16, and a support pad 52, will cut blanks of metal when the sleeve 22 is actuated downwardly by introducing fluid under pressure in the chamber 26. The draw pad 46 may move relative to the cutting and lifting ring 45 and relative to piston 42 as can be seen.

A further feature is the introduction of regulated air pressure from a source indicated at 60 through a suitable conduit 61 to the chamber indicated at 62, which surrounds the punch 14. The air under pressure acts down against the upper surface of the draw pad 46 to urge it into position shown in FIG. 1 under a continuous air pressure whenever the machine is turned on. This insures that the draw pad 46 is positioned against the shoulder of blanking and lift off ring 45, unless the upward force on the draw pad 46 exceeds the force from the air under pressure. There is air leakage out of the chamber 62 around the punch and also past the shoulder of ring 45, but the rate of leak is controlled sufficiently to maintain a known pressure on the pad.

In operation, the tube or sleeve 22 forms a double acting hydraulic piston and cylinder assembly in connection with the punch which will exert a force forcing the draw pad 46 and cutting ring 25 downwardly against the tooling 16. The positioning of a sheet of material indicated generally in dotted lines between the draw pad 46 and the support 52 is achieved in the usual manner. The blanking and draw pad cylinder 22 is operated by the programmed control 34 which controls servovalve 30 to provide fluid under pressure into the chamber 26 thereby forcing the sleeve 22 downwardly. The cutting ring edge 50 will engage the material indicated in dotted lines, and cut out a circular blank upon further downward movement. The stripper 51 is spring loaded as shown, and will collapse down below the level of the support 52 during the blanking movement. The draw pad 46 then engages the material and holds it against the support 52.

As the sleeve or tube moves, the force overcomes the air pressure on the draw pad 46 and the draw pad then is engaged by the bottom surface of the piston 42. The piston bears against the draw pad and the force of sleeve 22 tends to compress the elastomeric material 43 that is confined within the annular chamber 42. The elastomeric material 43 is selected so that it is deformable but because it is confined within the annular chamber 42 it cannot bulge or flow except as permitted by the confining walls and piston 42. With a load uniformly applied around its periphery the material will carry high axial loads to the draw pad 46.

If there is an eccentric load caused by the draw pad being cocked slightly so that one side of the piston tends to lift more than the other, the elastomeric material will flow to the side where the piston is cocked downwardly much like sluggish fluid. When the forces on the elastomer equalize, the elastomeric material will not flow or shift, but again will carry the required load with the piston cocked slightly about an axis generally normal to the actuator axis. Such tilting is illustrated somewhat by the dotted line tilting axis or plane shown at 63 in FIG. 1.

Thus a single actuator cylinder is utilized for cutting, and draw pad control during operation. The fluid pressure in chamber 26 will continue to act against the hold down pad 46 holding the blank in place during operation of the draw punch. FIG. 3 illustrates interrelated action of the punch and cutting — draw pad cylinders. The solid line indicated at 65 represents pressure versus time for the servovalve 30 and thus for the sleeve 22. Initially, the pressure is increased to a level where the cylinder 22 is moved downwardly toward the tooling 16, as shown in the first vertical segment, which cuts the blank by forcing ring 45 down. The pressure on sleeve 22 is held at a high level for cutting the metal. The punch motion, X, versus time plot is indicated at 66.

The force acting on sleeve 22 will be dropped steeply after cutting. As the draw stroke or punch stroke continues and increases the force on the draw pad holding the blank is controlled according to a pre-set program inserted in programmer 34. The program shown increases and then decreases as shown in solid lines before the punch stroke is completed. The force drops off substantially to a level below zero, that is, pressure in chamber 27 is greater than pressure in chamber 26. This means that fluid is provided to chamber 27 to lift the draw pad 46 off the blank to its retracted position.

The force lifting the sleeve 22 and the hold down pad assembly will overcome the force from the regulated air pressure.

FIG. 4 illustrates a mechanical operator or control equivalent to the servovalve operation shown in FIG. 1, for actuating blanking and hold down systems when mechanical presses are being converted to hydraulic operation. Where a large crankshaft operates the punch, a sleeve comprising the equivalent to the body 12 can be mounted surrounding the mechanical punch, and an outer double acting hydraulic cylinder 22 can be controlled with a mechanically programmed servovalve 74/75 in place of an electronically programmed servovalve 30. For example, the crankshaft which is indicated at 70 can be used for driving a cam 71 suitably located to operate against a cam follower 72 that is suitably guided against a spring 73. The spring operates against a spool valve 74 of a suitable valve member 75. The valve has output conduits 26B and 27B corresponding to the lines leading to chambers 26 and 27, respectively. Pressure feedback through lines 76 and 77 is applied at opposite ends of the spool valve to equalize the spring force 73 when the desired programmed pressure is achieved across piston 23. This provides hydraulic and mechanical substitutes for the electronics of FIG. 1. Cam 71 replaces program 34, spring 73 replaces summing junction 37, area on ends of valve spool 74 replaces delta-pressure transducer 35. Blocks 76A and 77A are suitable orifices or capillaries that provide a desired amount of damping in the feedback lines 76 and 77 to stabilize oscillations of spool valve 74 that may occur.

The cam 71 is formed to provide the same type of program shown in the plot 65 of FIG. 2. The draw pad control is thus synchronized with the movement of the crankshaft, because it is driven directly by the crankshaft. The shaft 70 of course may be a separate shaft positively driven from the crankshaft for the punch.

FIG. 5 is included to illustrate the generalized concept of the elastomeric swivel comprising the confined material 43. In the general showing of the swivel, a support 80, which may be fixed as shown or which may be a movable member exerting compressive loads, has an interior chamber 81 which is circular in cross section, much like a hydraulic cylinder. The chamber is substantially filled with an elastomeric material 82. The material is engaged on the bottom by a piston 83 that fits within chamber 81. There is no substantial space between the end of the piston and the wall of chamber 81. The inner end of the piston 83 has a partly rounded rim that permits the piston to cock slightly within the chamber without binding.

Reactive forces in direction of arrow 84 tend to compress the elastomeric material, but because it is confined the material carries substantial loads under compression.

When unequal loads are carried, the piston can cock as indicated by the angle at 85. The elastomeric material will compress on one side and under load will deform to carry the applied load with the piston cocked. In this way a compression carrying swivel is formed with the confined elastomeric material.

There is little resistance to swiveling, in that the elastomeric material flows much like a "viscous" fluid. It does not leak, however, in that it is a solid. The elastomer has low shear modules but high compression carrying capabilities.

The elastomeric material may be made of two materials having different shear moduli. A center core may have a lower viscosity than the exterior portion to basically lower the spring rate in rotation or pivoting, but still not compress substantially in volume under load.

The elastomeric material is not foam or similar compressible material. It carries compressive loads without compressing. While it would normally bulge under compression, the confining walls prevent bulging and the swiveling, or uneven loads, cause a flow until pressures are substantially equalized across the face of the material.

The "flowing" results from unequal compression loads within the confining walls of the chamber filled with elastomeric material.

The high load areas tend to squeeze down and this caused the material to bulge toward the lower load areas. Because the walls of the chamber confine the elastomeric material, the bulging or flowing starts to raise the loads in the lower load regions. This action occurs until the loads are equalized. The initial swivel resistance is therefore quite low. The swivel is essentially frictionless.

I claim:

1. For use in combination with devices exerting a force on a reaction member along a generally central axis, a low friction swivel connection between said device and the reaction member, comprising a chamber generally centered along said central axis and having a peripheral wall surrounding the central axis and one end closure wall extending transverse to the central axis and mounted to the peripheral wall, a movable end wall spaced from the one end wall and closing said chamber, a quantity of elastomeric material to substantially fill said chamber, said movable wall being generally flat and extending generally transverse to said central axis and having a periphery fitting closely within and movable relative to the peripheral wall, said movable wall engaging and bearing against a mating surface of said elastomeric material in a position to transfer load exerted generally in direction along said axis to said elastomeric material and then to the one end wall, said elastomeric material flowing upon application of a nonsymmetrical load in direction along said axis to said movable wall to tend to equalize pressure on said elastomeric material across the mating surfaces of the movable wall and elastomeric material, said elastomeric material carrying loads from said movable wall in axial direction to the one end wall without substantial compression of the elastomeric material.

2. The combination as specified in claim 1 wherein said chamber comprises an annular chamber, said movable wall and said elastomeric material forming annular rings around said central axis.

3. The combination of claim 1 wherein said chamber comprises a cylindrical chamber, said movable wall substantially closing one end of said cylindrical chamber.

4. For use in combination with first and second members carrying compressive force along a generally central axis, a compression carrying connection between said first and second members comprising wall means forming a chamber generally centered along said central axis and having a cross section, said wall means including a movable wall having a planar surface lying generally normal to the central axis and being substantially the same size as the chamber cross section, a filling of elastomeric material in said chamber and substantially filling a desired confining space in said chamber said filling having a generally planar surface engaged by said movable wall, said movable wall bearing against said elastomeric material under said compressive load between said first and second members, said elastomeric material yielding in shape upon an eccentric load being applied to said movable wall which tilts the movable wall to tend to equalize forces between the engaging in surfaces of said elastomeric material and movable wall, said elastomeric material carrying loads from said movable wall without substantial compression of the elastomeric material in direction along the central axis.

5. The combination specified in claim 4 wherein said elastomeric material comprises material having two different durometers, portions of said material spaced from said wall means being softer than the material adjacent said wall means.

* * * * *